US005699850A

United States Patent [19]

Beitelman et al.

[11] Patent Number: 5,699,850

[45] Date of Patent: Dec. 23, 1997

[54] METHOD AND APPARATUS FOR CONTROL OF STIRRING IN CONTINUOUS CASTING OF METALS

[75] Inventors: Leonid Beitelman, Thornhill; Joseph A. Mulcahy, Brooklin, both of Canada

[73] Assignee: J. Mulcahy Enterprises Inc., Whitby, Canada

[21] Appl. No.: 472,246

[22] Filed: Jun. 7, 1995

Related U.S. Application Data

[63] Continuation-in-part of Ser. No. 252,228, Jun. 1, 1994, abandoned, which is a continuation of Ser. No. 5,062, Jan. 15, 1993, abandoned.

[51] Int. Cl.[6] ..... B22D 11/04; B22D 27/02

[52] U.S. Cl. ..... 164/468; 164/504

[58] Field of Search ..... 164/466, 468, 164/502, 504

[56] References Cited

U.S. PATENT DOCUMENTS

| | | | |
|---|---|---|---|
| 4,933,005 | 6/1990 | Mulcahy et al. . | |
| 5,025,852 | 6/1991 | Mayrhofer | 164/468 |

FOREIGN PATENT DOCUMENTS

| | | | |
|---|---|---|---|
| 0 080 326 | 1/1983 | European Pat. Off. . | |
| 0 096 077 | 12/1983 | European Pat. Off. . | |
| 58-23554 | 2/1983 | Japan | 164/504 |
| 699156 | 10/1953 | United Kingdom | 164/468 |

*Primary Examiner*—Kuang Y. Lin
*Attorney, Agent, or Firm*—Sim & McBurney

[57] ABSTRACT

An induction stirring method wherein molten metal is electromagnetically stirred during continuous casting in a mold includes control of velocity of the stirring motion at the meniscus and the region adjacent to it, either to decrease or enhance the stirring of the molten metal produced by the main electromagnetic stirrer. An A.C. magnetic stirring modifier is positioned adjacent the region of meniscus to produce electromagnetic stirring of the molten metal at the meniscus, either to oppose the rotary motion of the main electromagnetic stirrer and provide a surface free from the stirring motion or to enhance the rotary stirring motion of the main magnetic stirrer. These two alternative modes of operation permit a casting machine to be used for casting molten metals requiring widely varying operating conditions.

18 Claims, 8 Drawing Sheets

METHOD AND APPARATUS FOR CONTROL OF STIRRING IN CONTINUOUS CASTING OF METALS

REFERENCE TO RELATED APPLICATION

This application is a continuation-in-part of patent application Ser. No. 08/252,228, filed Jun. 1, 1994 (now abandoned), which is a continuation application of Ser. No. 08/005,062, filed Jan. 15, 1993, (now abandoned).

FIELD OF INVENTION

The present invention relates to the continuous casting of metals and alloys, for example, steel.

BACKGROUND OF INVENTION

In continuous steel casting by pouring liquid metal into an open-end mold, stability of the free surface of the metal in the mold, often called the meniscus, plays a significant role in both process control and the quality of as-cast product.

Electromagnetic stirring of liquid steel within the mold, commonly known as M-EMS or simply EMS, is broadly employed in continuous casting mainly to improve quality of the strand surface/sub-surface and solidification structure (i.e., structure refinement, soundness and chemical homogeneity).

The two most common practices of continuous steel casting through an open-end mold impose entirely opposite requirements to the stirring conditions within the region of molten metal near its free surface at the mold top, i.e. the meniscus region.

Accordingly, casting mainly Al-killed steel grades via a submerged entry nozzle, hereafter SEN, under mold powder requires meniscus stability in order to prevent disruption of mold lubrication and powder entrapment into the cast body. A rotary stirring motion at the meniscus causes meniscus depression in the centre, waves and other disturbances of the free surface and excessive erosion of the casting nozzle when stirring intensity exceeds a certain level.

On the other hand, casting of Si-Mn deoxidized steel without mold powder is often accompanied by the defects of the cast product surface which can be alleviated or eliminated by initiating a flow of molten steel in the meniscus region.

Pinholes, blowholes, surface slag entrapment and subsurface inclusions can be reduced by intensive stirring in the meniscus region. The same requirement applies for casting low deoxidized, or so-called rimming substitute steel.

However, an excessive stirring intensity in the meniscus may cause an undesirable deterioration of the strand surface of Si-Mn deoxidized steels primarily cast into an oil-lubricated mold. Deep oscillation marks and laps can be formed on the strand surface as a result of overstirring in the meniscus.

Intensity of stirring in the meniscus must be limited to very low levels in the case of casting steel via SEN under mold powder.. Any disturbance of the meniscus in this case can result in irregularities of the mold lubrication by the mold flux and powder entrapment into the solidifying shell and bulk of the continuous cast strand. Meniscus stability is a critical prerequisite of successful casting operation with SEN.

The mentioned above requirements for stirring conditions within the meniscus region are greatly different from those applied to the rest of the mold.

In general an intensive stirring within the mold is necessary for obtaining improvements of the internal quality of cast products.

Thus improvements in the solidification structure, including its soundness and chemical uniformity, strongly respond to the intensity of stirring. Even in this case, stirring intensity should be controlled in order to avoid an undesirable level of depletion of chemical elements near the strand surface, so-called negative segregation.

Accordingly, it is difficult to provide independent control of stirring within the adjacent regions of the mold in order to comply with the provisions imposed by the different casting operations.

The problem becomes most challenging when both casting practices, i.e., one without the mold powder and open stream pouring and another with SEN and mold powder, are being utilized at the same production facility.

In order to overcome the problem of overstirring in the meniscus, an EMS coils are commonly arranged close to the mold exit and farther from the meniscus. With powerful EMS, and especially in smaller cross-sectional size molds this measure has very limited success.

The near mold exit stirrer arrangement combined with another induction stirrer arranged in the upper portion of the mold was suggested in the U.S. Pat. No. 5,025,852 of Jun. 25, 1991 in the attempt to resolve contradictory requirements pertaining to casting with or without SEN while utilizing the same mold equipped with EMS.

The upper EMS, according to this patent, should be used for casting without SEN and the lower EMS will operate only at casting with SEN. As was noted before, a lower arrangement of EMS in the mold does not prevent or eliminate excessive stirring motion in the meniscus if the stirring intensity is used to attain adequate improvements in solidification structure of billets and blooms.

There are some other known methods in prior art with the objective to change the stirring motion in the meniscus region. Japanese Patent Publication No. 58-23554 describes a method of decreasing the intensity of stirring in the meniscus region by means of an induction coil arranged around the mold in the area corresponding to this region and providing rotating stirring motion opposite to that induced by the main EMS coil arranged below.

The main drawback of this method is that it does not provide a control of stirring flow in the meniscus. Because there is no method of direct measuring stirring intensity in the meniscus during continuous casting of steel, and even visual observation of the meniscus is obstructed by its location within the mold and by the mold powder in case of casting with mold flux lubrication, indirect methods of evaluating stirring intensity of the auxiliary and the main stirrers should be applied in order to achieve a certain desired effect by means of controlling the said stirring intensities. The Japanese Patent Publication No. 58-23554 does not describe any methods of measuring stirring intensity in the meniscus or relating it to the stirring intensity of the main EMS, which would be necessary to provide control of the stirring intensities produced by both devices, i.e., the main EMS and the auxiliary induction coil. Therefore this method has never found implementation in the industrial practice.

Another possible way of alleviating the problem of excessive stirring motion in the meniscus was described in the U.S. Pat. No. 4,933,005 of Jun. 12, 1990, assigned to the assignee thereof. According to this patent, a strong horizontal D.C. magnetic field is applied across the meniscus region of the mold while a stirring action has concurrently been induced by means of an EMS arranged below in the mold. A D.C. magnetic field, by interacting with spinning melt, produces an electromagnetic force directed opposite to the liquid metal motion and thereby reduces that motion velocity.

This method, similar to that described in the Japanese Patent Publication No. 58-23554, does not provide means for a proportionate control of the flow motion in the meniscus with respect to the stirring intensity produced by the main EMS. Also this method requires a very strong D.C. magnetic field, and thereby large induction coils, in order to be effective. Because magnetic force produced by D.C. magnetic field is proportional to the velocity of liquid metal which is comparatively low and continuously decreasing due to clamping action of the said magnetic force, D.C. magnetic flux density should be sufficient to compensate for that. Magnetic flux density of D.C. magnetic field used in the steel industry typically does not exceed 0.35 to 0.5 T. This level of magnetic flux density, as experimental work showed, is not adequate to control effectively stirring motion in the meniscus region in most of industrial applications of EMS.

SUMMARY OF INVENTION

In accordance with the present invention, there is provided an improved method of controlling electromagnetic stirring intensity within strands of continuously cast billets and blooms. This invention has two objectives:

One such objective is to provide quantitative control of stirring intensity in the meniscus of a continuous casting mold and, therefore, to provide the flexibility of adaptation of stirring conditions to the casting process requirements.

A second such objective is to improve solidification structure refinement and overall internal quality of the continuous casting strand through the effects provided by superimposition of the magnetic fields produced by auxiliary and main stirring devices, e.g. A.C. MSM and EMS.

In the present invention, an electromagnetic A.C. coil similar to but smaller than that of a main electromagnetic stirrer installed downstream is arranged around the mold in the meniscus area. This device is in essence another induction stirrer, similar to the main stirrer which is arranged axially symmetrical around the mold and farther down from the meniscus. However, the coil in the upper part of the mold is intended to counterbalance and equalize, or enhance, depending on specific objectives, the stirring motion in the adjacent volume of liquid metal, the metal motion which is originated by the main stirrer. Therefore, the working function of this stirrer is to modify the direction and/or intensity of the stirring flow in the meniscus region induced by the main stirrer and henceforth the device performing that function will be called A.C. magnetic stirring modifier or A.C. MSM. The action of the A.C. MSM is typically contained within the upper portion of molten metal pool, comprising approximately 10 to 15 percent of its volume confined by the mold.

The stirring motion within that portion of the liquid metal pool is caused and maintained by the dynamic forces, i.e., viscosity, which transmit the momentum of the stirring flow created by the EMS arranged in the lower portion of the mold. Momentum is defined by the magnetic forces distributed within a certain defined volume of liquid metal and the mass of that metal.

Control of the flow motion in the meniscus region is the result of a variable ratio, or a series of ratios, between the momentum produced by the A.C. MSM within the meniscus region and the momentum produced within the active stirring zone of the main EMS. Therefore, a momentum in the meniscus region required to compensate for the momentum transmitted to this region from the main stirring zone will be proportional to the liquid metal mass affected by the magnetic forces applied to this mass of metal.

Each of the momentums produced correspondingly by the EMS and A.C. MSM is also proportional to their respective magnetic torques, which in turn are defined and controlled by the design and operating parameters of respective induction coils. Thus, the stirring flow in the meniscus region can be controlled through design features of the inductors, for example active stirring zone length, and operating parameters, such as current or power input and frequency. Although, a part of a single magnetohydrodynamic system, both the A.C. MSM and the EMS operate, however, from independent power sources. Therefore, the current supplied to both sets of induction coils can be of the same variable value frequency or different value frequencies.

The spacial proximity of the A.C. MSM and EMS induction coils results in superimposition of their respective magnetic fields and creating a resultant magnetic field. When each of the two original magnetic fields operates at different frequency, the resultant magnetic field becomes polyharmonic or constituted by periodic oscillations with coinciding amplitudes at a multitude of frequencies each of which is an integral multiple of the same base frequency. This base frequency characterizes the beat of the resultant magnetic field, which has an oscillation period greater than the oscillation periods of either of the original fields.

Therefore, parameters of the new resultant magnetic field,. i.e., magnetic flux density and induced current density, as well as their derivatives such as magnetic force, magnetic pressure and oscillatory flow momentum, will acquire polyharmonic character and the amplitudes of their oscillations will be greater than those of the original magnetic fields. These new characteristics of the resultant magnetic field, i.e., greater amplitude of oscillation and greater average values of magnetic flux density, induced current and magnetic forces initiate a series of new physical phenomena within the melt which ultimately result in the improvement of solidification structure and overall quality of cast metals. Most important of those phenomena are the parametric resonance and cavitation processes which may occur when certain conditions have been met.

The parametric resonance, either of the melt or the dendrites of the solidification front occurs when the frequencies of oscillating dynamic forces, for example, electromagnetic force, magnetic pressure and momentum, are close to or coincide with the frequencies of free oscillation of the melt or dendrites in the field of gravity. The probability of parametric resonance arises due to the polyharmonic nature of the resultant magnetic field and increased amplitude of its oscillation (beat). All dynamic parameters affecting dendrite fragmentation, i.e. pressure and momentum, are substantially increased and, therefore, more effective when the parametric resonance takes place.

The cavitation process also may take place when the local pressure within melt becomes equal to that of the vapour of metal or its alloy composition components. The solidification front is the most probable place where cavitation can occur firstly, because of the presence of another phase makes it easier to form a cavity during oscillation of the melt in parametric resonance and secondly, because the induced currents sharply change their direction at the liquid and solid phase interface due to their different electrical conductivity, which results in creating an alternating electromagnetic body force which, in turn, results in alternating positive and negative pressure at the solidification front.

The simultaneous occurrence of parametric resonance within the melt and at the solidification front supplemented by the cavitating process results in a synergetic effect on solidification structure refinement and overall internal quality of as-cast product. These effects are unattainable with conventional stirring methods based on single-frequency electromagnetic fields, because the shearing force produced by conventional electromagnetic stirring at the solidification front dissipates within the viscous boundary layer, affecting, thereby mainly the portions of dendrite protruding from that layer. The oscillatory dynamic forces, such as magnetic forces are volumetric and affect the whole dendrite structure.

Similarly, local pressure associated with the shock waves of cavitation is effectively transmitted through the boundary layer and exerted upon the dendrites resulting in their fragmentation.

Thus considering both aspects of this invention makes it broadly applicable to all electroconductive materials, i.e., metals and alloys which can be electromagnetically stirred, and where either of the two objectives to be achieved:

i. Control of stirring intensity within some region or regions of the melt without interference with stirring within other adjacent regions and supplemented by the improved refinement of the solidification structure and overall internal quality of as-cast products.

ii. Improvement of effectiveness of electromagnetic stirring with respect to the solidification structure refinement and overall internal quality of as-cast products.

The invention is broadly applicable to all electroconductive materials, i.e. metals and alloys, which can be electromagnetically stirred and where control of stirring intensity is required within some region or regions without interference with stirring Within other regions of the liquid pool. The invention is applicable to a wide variety of spacial orientation of a vessel containing the molten metal. For example, a casting mold may be arranged vertically, inclined or horizontally.

DESCRIPTION OF PREFERRED EMBODIMENT

Figure 1:
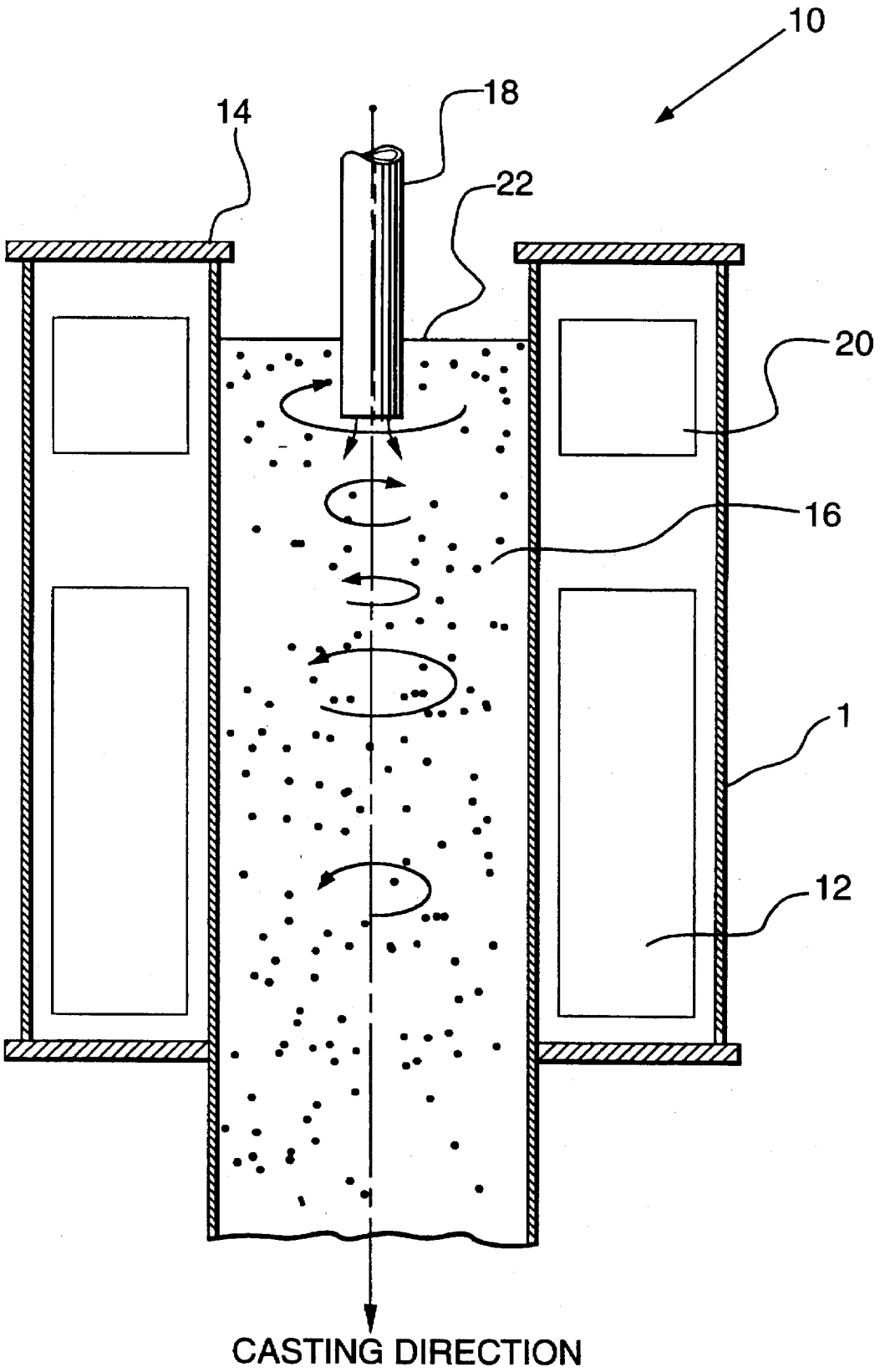
FIG. 1 is a schematic of an arrangement of an A.C. magnetic stirring modifier (A.C. MSM) and an electromagnetic stirrer (EMS), with respect to a casting mold in accordance with one embodiment of the invention.
Figure 2:
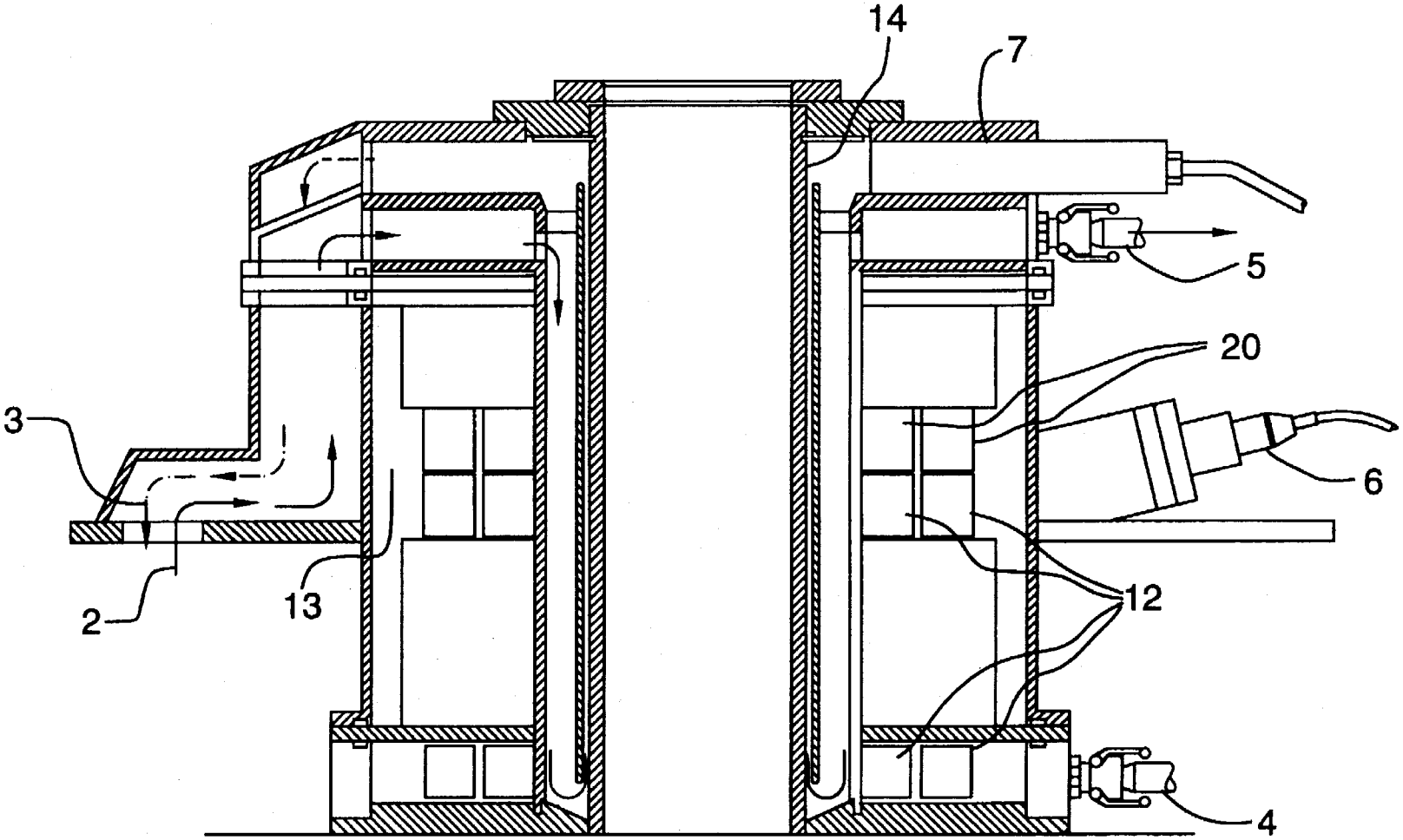
FIG. 2 is an elevational sectional view of the mechanical arrangement of the A.C. MSM and the EMS within the mold housing and corresponding to the schematic arrangement of FIG. 1.

Referring to the drawings, FIG. 1 is a schematic depiction of an arrangement of an A.C. MSM and an EMS within a mold housing assembly of a continuous casting machine 10 in accordance with one embodiment of the present invention. FIG. 2 is a more detailed depiction of the mechanical elements of the mold assembly.

As seen from FIGS. 1 and 2, a continuous casting mold 14 is cooled by the water flow 2, 3, and the induction coils 12 and 20 of the A.C. MSM and the EMS respectively are arranged within the compartment 13 which isolate them from the mold cooling system. Induction coil cooling is provided by the independent cooling water supply 4, 5.

The electrical terminals of the induction coils 12 and 20 are assembled within a terminal box 6 mounted on the outer wall of the mold housing 1. The compartment 13 accommodating the induction coils 12 and 20 is situated below a melt level control 7.

Liquid metal, e.g. steel, is poured, as illustrated in FIG. 1, into center of the upper open end of the mold 14 through a refractory ceramic tube 18 termed a Submerged entry nozzle or, alternatively, as a free fall stream discharging from a tundish in the open stream casting practice.

A thin shell of solid metal is formed at the interface between the melt and the mold starting at the melt free surface 22 which is maintained by the level control system. 7 within a narrow range of a constant level.

As solidification of the melt progresses in time, the strand is continuously withdrawn from the mold and replaced by a new incoming mass of the melt, thereby providing a continuous casting process.

A series of induction coils 12, is arranged around the periphery of a vertical casting mold 14, at its lower portion to comprise an A.C. electromagnetic stirrer (EMS). The EMS coils 12, when energized, induce rotary motion of a strand of molten metal 16 within the mold 14 about its longitudinal axis.

In accordance with the present invention, A.C. MSM induction coils 20, are spaced around the vertical mold 14, adjacent to the free upper surface or meniscus 22 of the strand of molten metal 16. The EMS coils 12 are designed to induce a strong rotational flow of molten metal in the strand of molten metal 16 within the mold 14.

The intensity of this rotational flow is characterized by its rotational velocity $U_R$ which, in turn, depends on the parameters defying the magnetic torque, in accordance with the following expressions:

$$U_R = K\sqrt{T/m} \quad (1)$$

$$\text{wherein } T = 0.5\pi^2 f \cdot \sigma B^2 R^4 \quad (2)$$

where T is the magnetic torque applied to the molten metal m is the mass of metal affected by the torque

T

K is a proportionality coefficient f is the current frequency

σ is the liquid metal electrical conductivity

B is the magnetic flux density

R is the stirred pool radius

As seen from relationship (1), a change of the magnetic torque of any given induction system, e.g. A.C. MSM, is determined by variables of magnetic induction B and frequency f. Therefore, magnetic torque can be controlled by the system operating parameters, i.e., current or power input and frequency.

Figure 4:
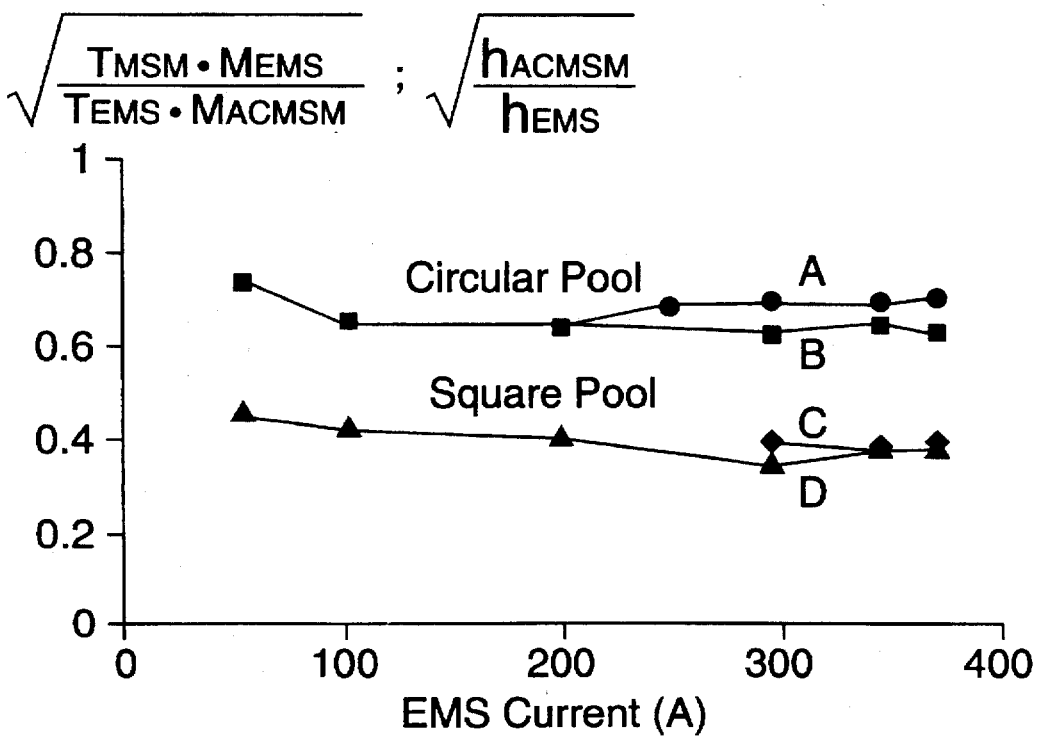
FIG. 4 is a graphical representation of square root of ratios of the magnetic torques of the A.C. MSM and the EMS of FIG. 1 which correspond to the condition of stirring motion equilibrium in the meniscus of mercury pools. The lines A and B respectively represent the square root of the magnetic torque ratios for the pools of circular and square cross-sectional geometries. The lines C and D' represent square root of measured depression in the meniscus of the stirring pools.

Because the rotational velocity in the meniscus region is defined by both magnetic torques of the A.C. MSM and the EMS, the ratio of the magnetic torques controls the stirring rotational velocity in the meniscus. If stirring motion in the meniscus originated by the EMS is equalized by a counter-directed stirring motion caused by the A.C. MSM at a certain ratio of its magnetic torque to the EMS torque, then this motion equilibrium will be sustained within an operational range of the EMS current input as far as the torque ratio is being maintained. This relationship is shown in FIG. 4 where the experimental data for mercury pools of circular and square geometries are presented. The magnetic torque ratio is expressed as square root of the torque per metal mass unit in accordance with equation (1).

Figure 3:
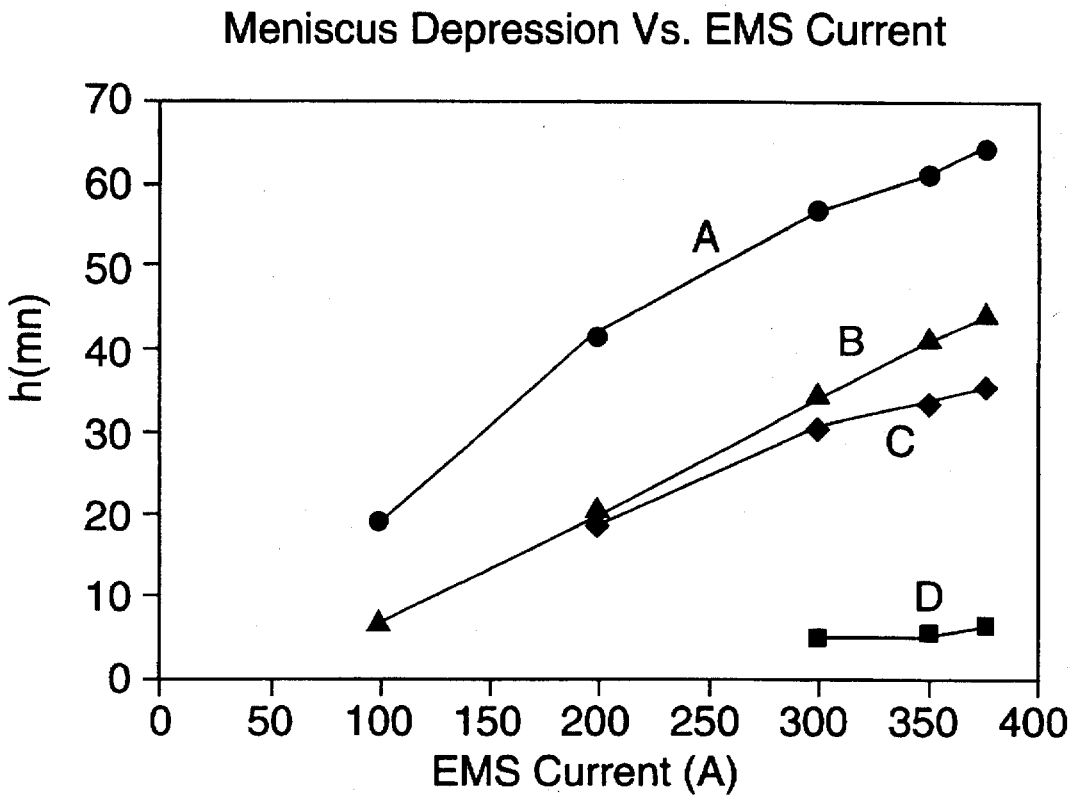
FIG. 3 is a graphical representation of the measured meniscus depression in mercury pools of circular and square geometries subjected to electromagnetic stirring provided by the EMS and the A.C. MSM. The direction of stirring provided by the A.C. MSM in that case was opposing the stirring produced by the EMS and enabled to counterbalance its stirring motion in the meniscus. The lines A and B respectively represent meniscus depressions in the circular and square geometry pools at different levels of the EMS current. The lines C and D respectively represent meniscus depressions caused by stirring action of the A.C. MSM at the condition required to counterbalance the stirring motion in the meniscus produced by the EMS.

The rotational velocity $U_R$ in the meniscus can also be expressed through a relationship with meniscus depression caused by the rotational motion:

$$U_R = \sqrt{2gh} \quad (3)$$

where h is the depth of meniscus depression g is the acceleration due to gravity The results of meniscus depression measurements are presented in FIG. 3, where the meniscus depression caused by the A.C. MSM and expressed by the line C for the circular geometry stirring pool and the line D for the square geometry pool corresponds to stirring motion equilibrium in the meniscus when the stirring intensity of the EMS corresponds to the meniscus depression expressed by the respective lines A and B.

Ratios of rotational velocities of the counter-rotating stirring flows in the meniscus produced respectively by the A.C. MSM 20 and the EMS 12 and expressed through meniscus depression h in accordance with equation (3) are also presented in FIG. 4.

These velocities were determined via direct measurements of meniscus depression in mercury pools when velocities were of values required to cancel any rotation in the meniscus and to bring it to the state of dynamic equilibrium.

The ratios of velocities of both the counter-rotating flows and the magnetic torques are in good agreement. Therefore validation of the calculated momentums and magnetic torques can be performed through physical modelling involving assessment of stirring velocity in the meniscus.

Figure 5:
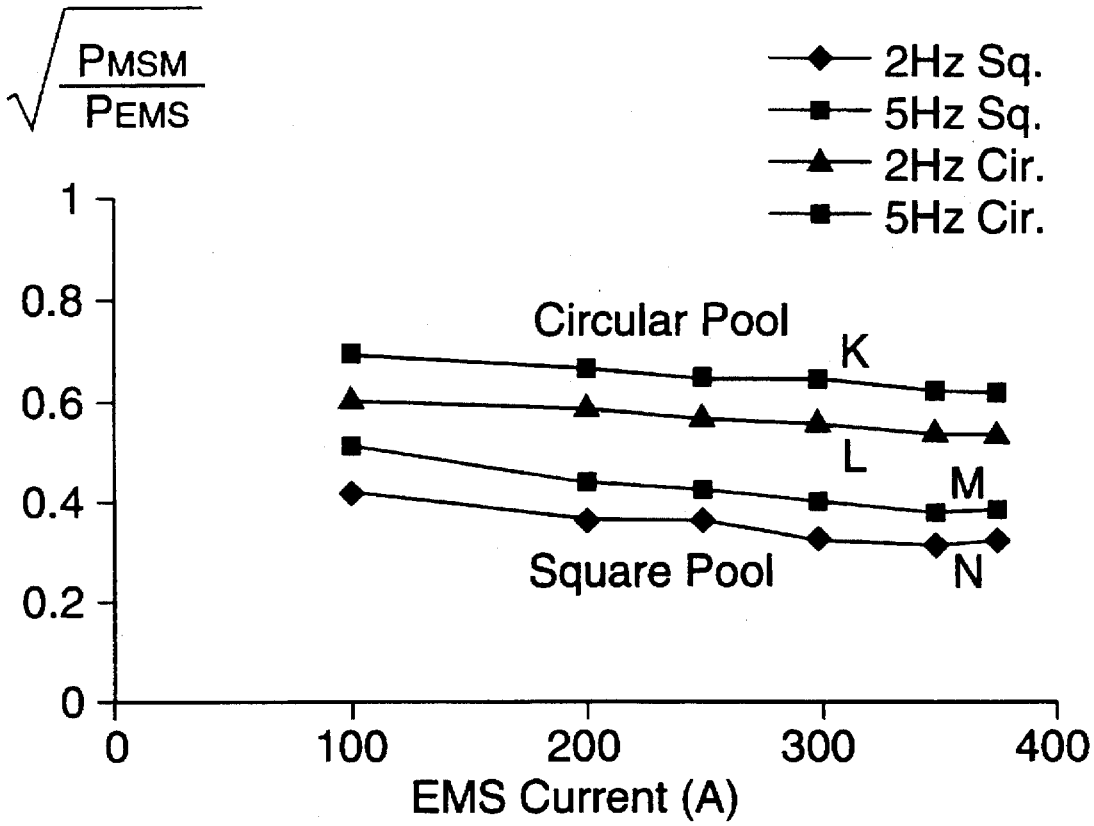
FIG. 5 is a graphical representation of the square root of ratios of the power input to the A.C. MSM and the EMS which correspond to the motion equilibrium in the meniscus of the mercury pools of circular and square geometries. Two pairs of lines K and L and M and N respectively represent square root of the said power input ratios at frequencies 5 and 2 Hz.

Having established desirable ratios of magnetic torque of the A.C. MSM and magnetic torque of the EMS pertinent to certain stirring conditions in the meniscus, including complete equilibrium of the opposing stirring motions, the A.C. MSM and EMS operating parameters can be determined to correspond those preselected conditions. As shown in FIG. 5, the power input ratios for the A.C. MSM 20 and the EMS 12 are in good agreement with the ratios of magnetic torques and rotational velocities expressed through meniscus depression.

Therefore, for a given casting installation equipped with an integrated A.C. MSM-EMS system, operating parameters, e.g. power input, can provide means for an accurate control of stirring conditions in the meniscus taking into account intensity of stirring produced by the main EMS. This control provides a variable stirring velocity in the meniscus within a range from values exceeding the stirring velocity originated by the EMS when the A.C. MSM operates in the way to enhance the primary stirring motion to the stirring velocity reduced to its virtual zero value when the A.C. MSM produces the opposing rotational motion.

In order to counterbalance the stirring motion in the meniscus produced by the EMS coils 12, in accordance with the present invention, the induction coils 20 of A.C. MSM are energized to induce a stirring action within the liquid metal at the meniscus opposite to that caused by the EMS coils 12. All the previous considerations with respect to a rotary movement of liquid metal are applicable to the stirring produced by the A.C. MSM coils 20.

The A.C. MSM coils 20 are substantially smaller and require less power for their operation than the EMS coils 12 due to a much less magnetic torque and flow momentum expected for them to produce to counteract the rotational motion at the meniscus induced by the EMS coils 12.

Figure 6:
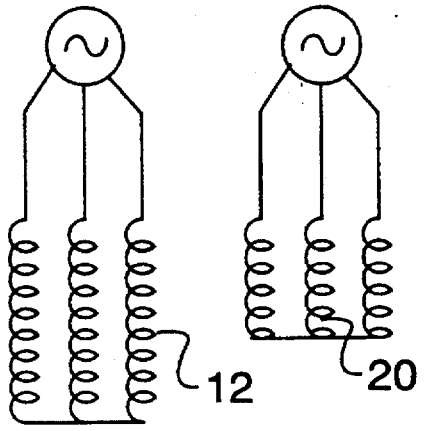
FIG. 6 is a single-line diagram of possible electrical connections for the induction coils of the A.C. magnetic stirrer modifier and the EMS of FIG. 1.

In accordance with an embodiment of this invention, the A.C. MSM coils 20 are energized from a power supply independent form the EMS coils 12, as shown by single line diagrams in FIG. 6. In order to provide fine control over stirring action at the meniscus which is determined by the variables of EMS (for example, magnetic induction), the current is supplied to the A.C. MSM coils 20 from an independent source from that of the EMS coils 12, as shown by single line diagrams in FIG. 6. This arrangement allows for independent control of stirring actions of either of the EMS or the A.C. MSM coils regardless of the directional pattern of stirring, namely unirotational or counter-rotational.

The independent control of stirring motion at the meniscus provided by the use of the A.C. MSM coils 20 enables a greater flexibility and accuracy of the stirring process control with a possibility of achieving equalization of the opposite stirring motion at the meniscus; as illustrated in FIGS. 4 and 5.

In order to equalize the stirring velocities caused by the EMS and A.C. MSM coils, their magnetic torque ratios must be of the same value within a range of the EMS operating current. For example, for a square geometry stirring pool, if the magnetic torque of EMS corresponds to the EMS current input of 300 amperes, then magnetic torque of A.C. MSM which provides opposing rotational stirring in the meniscus region should be of a value of 0.16 of the EMS torque, which corresponds to the ratio 0.4 of their square rook values within the full range of the EMS current, as shown in FIG. 4.

This level of magnetic torque ratios is attained through matching the A.C. MSM power input to that of EMS in order to obtain the same ratio, i.e., the power input of A.C. MSM should be 0.16 of the EMS power input or 0.4 of their square root ratio, as shown in FIG. 5.

Figure 7:
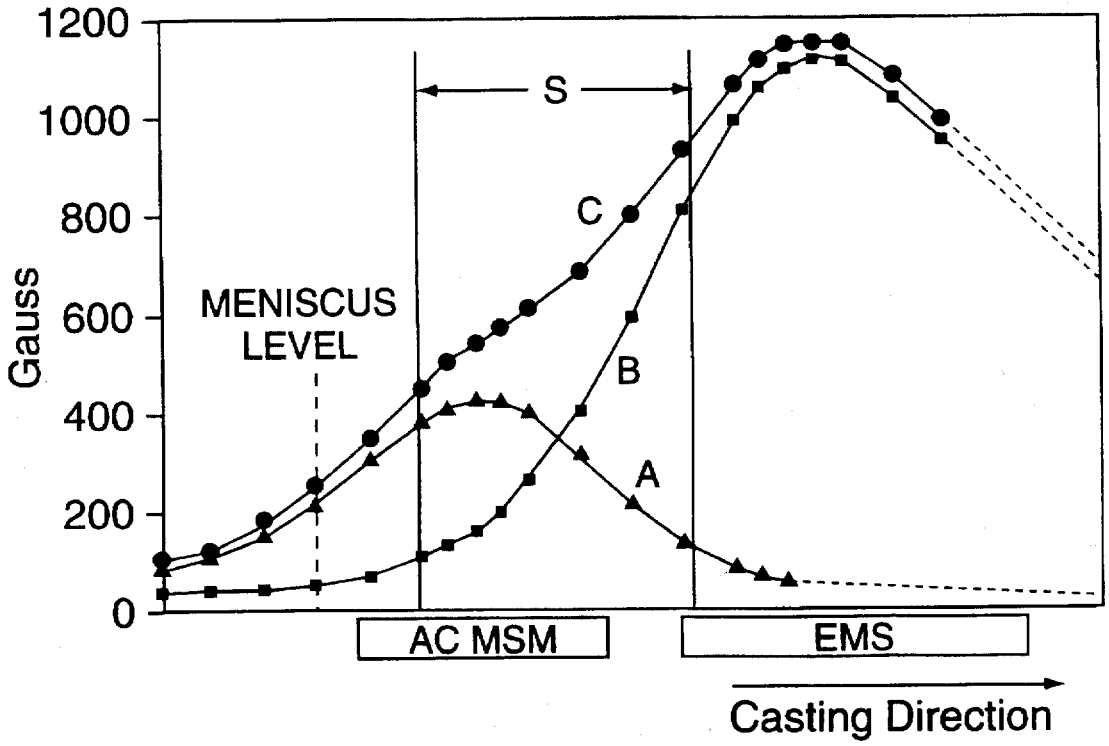
FIG. 7 is a graphical representation of the measured magnetic flux density axial profile at one of the possible electrical settings of the EMS and A.C. MSM. The curves A and B respectively represent magnetic flux density of the A.C. MSM and EMS. The curve C represents magnetic flux density of the resultant magnetic field produced by superpositioning magnetic fields of the A.C. MSM and EMS. The interval S delineates roughly the spacial boundaries of most pronounced effect of the resultant magnetic field.
Figure 8A:
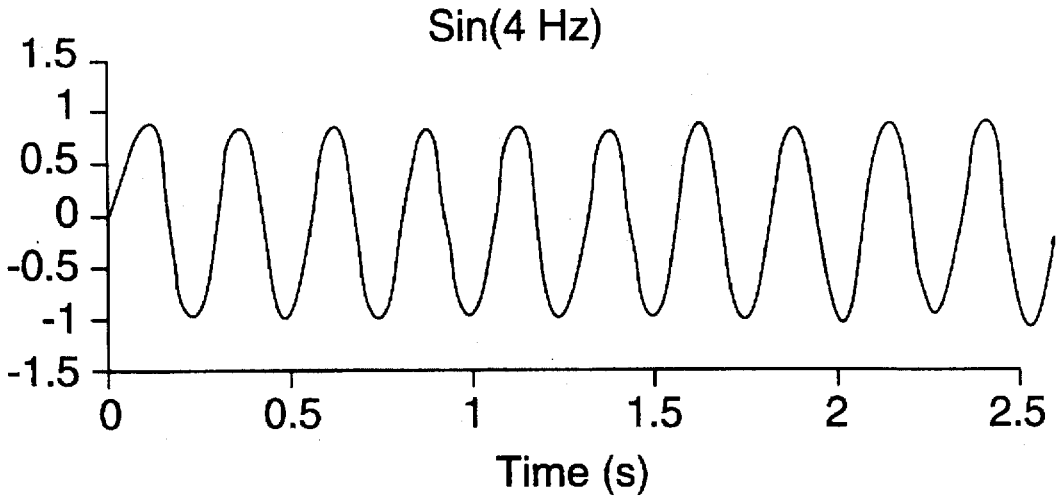
FIG. 8 is a graphical representation of the computational simulation of a complex polyharmonic periodical function obtained by superimposing two simple sinusoidal type functions; i.e., the sinusoidal curve with oscillating frequency 4 Hz presented in FIG. 8*a* and the similar curve with oscillating frequency 5 Hz presented in FIG. 8*b;*
Figure 8B:
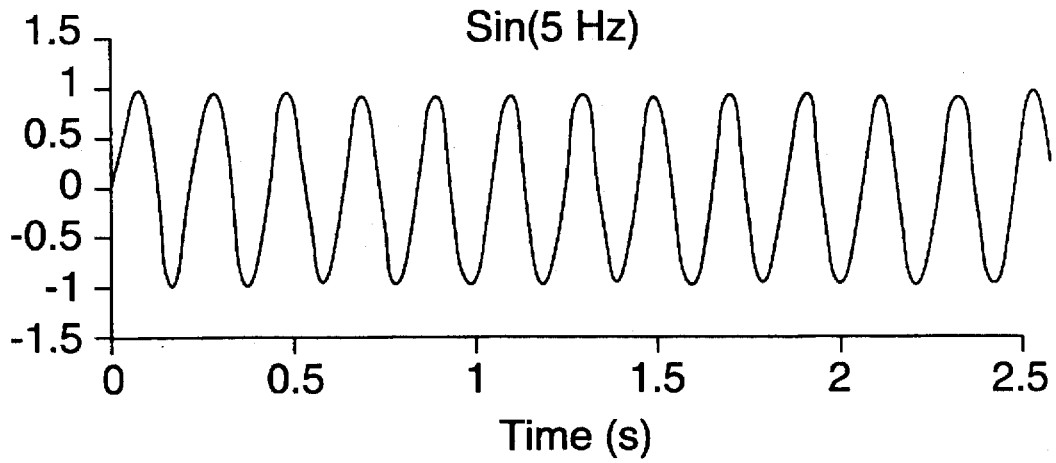
Figure 8C:
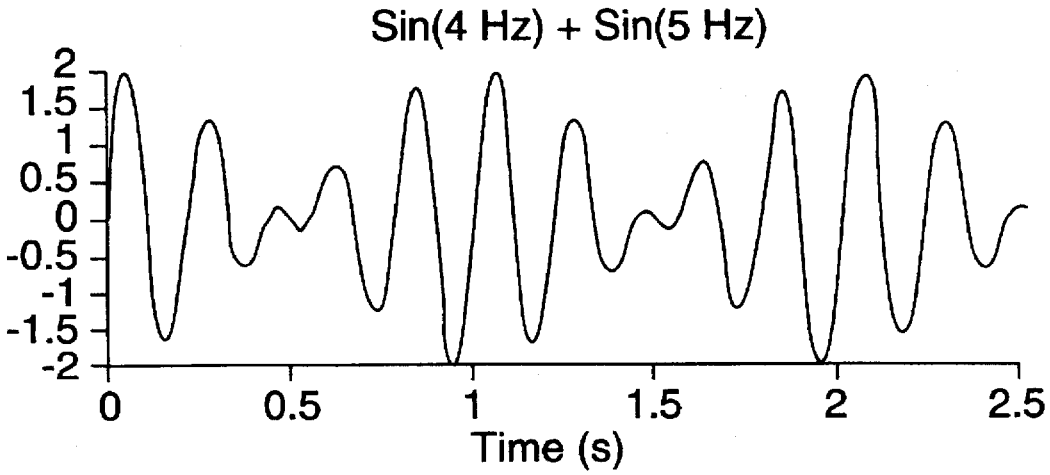

A spacial proximity of the A.C. MSM and the EMS provides for overlapping or superposition of their magnetic fields and creating the resultant magnetic field. FIG. 7 schematically represents axial profiles of magnetic flux density produced by the A.C. MSM and the EMS, respectively assigned by the letters A and B, and magnetic flux density C of the resultant magnetic field produced by superposition of the fields A and B. The most pronounced effect of the magnetic field superposition occurs within the spacial interval S which encompasses part of each A.C. MSM and EMS structures and space between them. A less profound effect of this superposition may be traced well beyond that interval. This process of superposition of two single-frequency magnetic fields is similar to and may be simulated by the superimposing two simple harmonic functions such as sine curves and obtaining a complex polyharmonic function as presented in FIGS. 8 (a,b,c).

Figure 9:
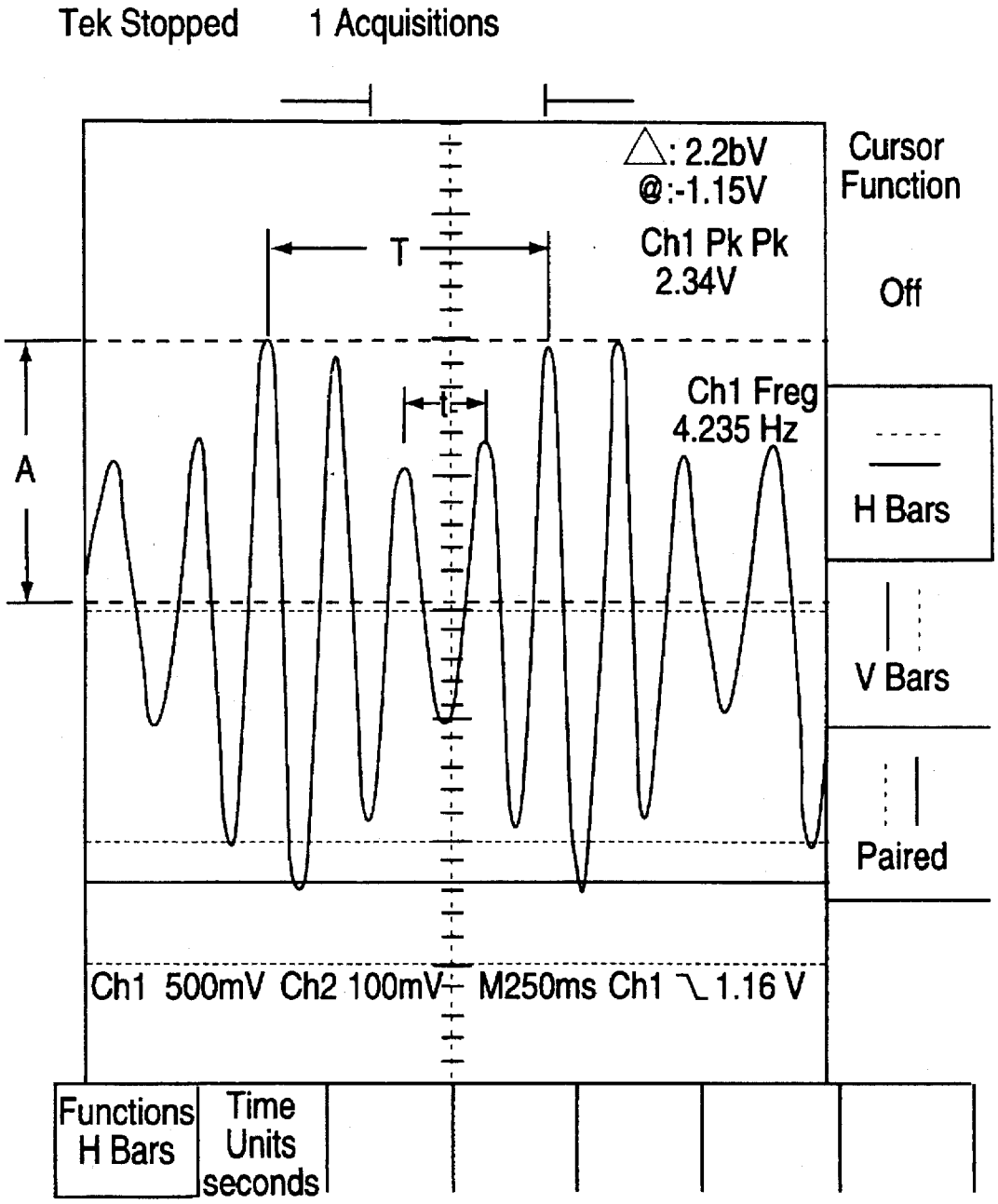
FIG. 9 is an oscillogram of magnetic flux density of the actual resultant magnetic field obtained by superimposition of the magnetic fields produced by the A.C. MSM operating at 4.0 Hz and EMS operating at 5.0 Hz.
Figure 10:
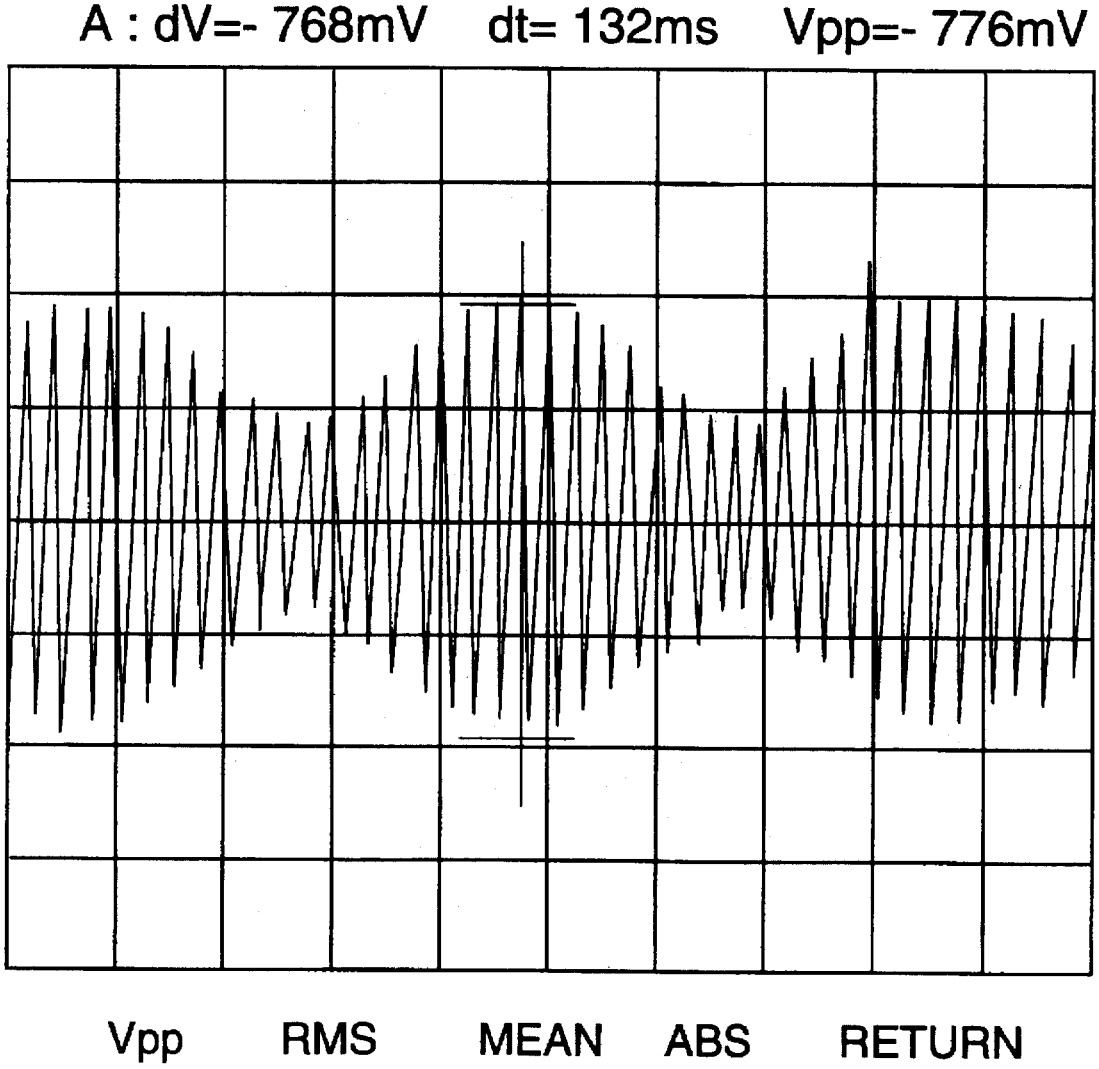
FIG. 10 is an oscillogram of magnetic flux density of the resultant magnetic field obtained by superimposition of the A.C. MSM magnetic field at frequency 3.75 Hz and the EMS magnetic field at frequency 4.0 Hz. The recording presented in FIG. 10 is similar to that in FIG. 9, except a smaller scale was used in the former to accentuate the oscillation beat.

The resultant magnetic field, therefore, becomes polyharmonic when amplitude of oscillations at different frequencies coincide which set forth oscillating of the resultant magnetic field in form of beats at a certain base frequency which is lower than either of the frequencies of the two original magnetic fields. FIGS. 9 and 10 show the examples of measured magnetic flux density of the resultant electromagnetic fields produced by the A.C. MSM and EMS and corresponding to the spacial interval S in FIG. 7. The magnetic flux density, as shown in these examples, and other parameters of the resultant magnetic field and their derivatives (e.g. magnetic force, pressure, momentum), have an increased amplitude A of oscillation of a variable period t, while the beating oscillations have a period T inversely proportional to the base frequency, as shown in FIG. 9. The averaged values of the parameters of the resultant field are also increased and their attenuation on the way through the copper mold and/or the solid shell and within the melt is less than that of the original magnetic fields owing to the fact of a lower frequency of the oscillation beat.

Therefore, new oscillatory dynamic forces have been initiated within the melt which may create, in turn, the condition of parametric resonance when frequencies of their oscillations are close to or coincide with some of the frequencies of melt free oscillation in the field of gravity. A probability of initiating such resonance in liquid metals, for example, steel, is increasing when oscillations of these dynamic forces are polyharmonic and amplitude is large, as it is in the situation of superimposition of two A.C. magnetic fields. Also the probability of parametric resonance within liquid metals increases because both original and the resultant electromagnetic fields, in accordance with embodiments of this invention, have frequencies typically within a range of 1 to 15 Hz which, according to the published data, is also the range of frequency of liquid metals free oscillation in most metallurgical systems.

In order to suit better particular metallurgical systems, the frequency of the resultant magnetic field may be adjusted through a ratio of the original field frequencies, i.e., $f_{ACMSM}/f_{EMS}$, because those frequencies determine the base frequency of the resultant field.

The closer this ratio to unity, the lower the base frequency becomes. The amplitude of oscillation of magnetic flux density, induced current and derived from that dynamic forces can be controlled by the current input of either one of the two or both original electromagnetic fields.

Similar to the parametric resonance within the melt, another parametric resonance can be obtained at the solidification front of the cast strand when one of the harmonics of the applied dynamic forces (e.g., electromagnetic force, pressure or momentum) initiates the resonant oscillation of some dendrites.

Vibratory motions set forth Within the melt may initiate formation of small cavities as a result of liquid rupture when a local pressure becomes equal to or less than the pressure of vapour of the melt or partial vapour pressures of the constituent alloying elements. The cavities collapse instantaneously as soon as the vapour is condensed and in the course of this process shock waves of high pressure are being generated and exerted to the neighbouring dendrites. The process of parametric resonance and accompanied it cavitation in liquid metals are well documented for the systems designed to achieve solidification structure refining by means of mechanically induced vibrations.

The cavitation also may be produced or facilitated by the fact of a change of induced current streamline directions at the interface of the liquid and solid phases due to difference in their electrical conductivity.

Consequently, the magnetic force and magnetic pressure originated at such localities will be of alternating character, e.g. positive-to-negative. Thus a cavity can be formed in the melt at the phase interface when the local negative pressure is equal or lower than the partial vapour pressures.

The results of previous works have demonstrated that all above mentioned .mechanisms, i.e., oscillatory momentum within liquid metal, parametric resonance and cavitations result in effective improvement of solidification Structure of the cast products through crystalline refinement and metal degassing. Therefore, application of the superimposed A.C. magnetic fields, such as those produced by the A.C. MSM and EMS and shown in FIGS. 9 and 10, produces a further improvement of the cast product quality in comparison with the conventional electromagnetic stirring.

SUMMARY OF DISCLOSURE

In summary of this disclosure, the present invention provides an improved method of controlling stirring motion in the free surface of molten metal contained within a casting mold and caused by electromagnetic stirring applied to this metal, to minimize such motion in the free surface or to achieve its enhancement within a single production unit by employing an induction stirrer modifier in the form of an electromagnetic stirrer arranged around the melt free surface region and being auxiliary and adjacent to the main electromagnetic stirrer. This invention also provides an improved method of solidification structure refining and overall internal quality improvement in continuous casting of billets and blooms with electromagnetic stirring achieved by superimposing of single-frequency electromagnetic fields of the stirring modifier and the main stirrer operating at different frequencies and thereby obtaining a resultant polyharmonic magnetic field. Modifications are possible within the scope of this invention.

What we claim is:

1. An induction stirring method for continuous casting of billets and blooms from molten metals, which comprises:

providing a vertical continuous casting mold having first a.c. electromagnetic induction coils in a main portion of the mold and second a.c. electromagnetic induction coils located above the first electromagnetic induction coils and adjacent an upper entrance to the mold, said second electromagnetic induction coils being capable of providing two modes of electromagnetic stirring dependent upon the continuous casting process employed, feeding molten metal to the mold, electromagnetically inducing stirring of molten metal within the continuous casting mold through rotation of the molten metal about a vertical axis with such intensity as normally to result in turbulence in the molten metal including its free surface, by applying a first rotating magnetic field to said molten metal from said first electromagnetic induction coils, applying simultaneously to said molten metal in the mold at a location adjacent the free surface of said molten metal, a second rotating magnetic field from said second electromagnetic induction coils, said second rotating magnetic field provided by said second electromagnetic induction coils being of an intensity which selectively is:

(a) at least sufficient to minimize the stirring motion and disturbances induced by said first electromagnetic induction coils in said free surface area when the second electromagnetic induction coils are operated in said first mode of operation to produce the second rotating magnetic field rotating in a direction opposite to the direction of rotation of the first rotating magnetic field when submerged entry nozzle casting is effected with surface mold powder, or (b) at least sufficient to enhance the stirring motion induced by said first electromagnetic induction coils in said free surface area when the second electromagnetic induction coils are operated in said second mode of operation to produce the second rotating magnetic fields rotating in a direction which is the same as the direction of rotation of said first rotating magnetic field when casting is effected without mold powder.

2. The method of claim 1, wherein said second rotating magnetic field is applied in a location adjacent the free surface area of said molten metal.

3. The method of claim 1, wherein the second electromagnetic induction coils is controlled by an A.C. current supplied from a power source common to and shared with the first electromagnetic induction coils.

4. The method of claim 1, wherein the second electromagnetic induction coils is controlled by an A.C. current supplied by an independent power source from a power source for the first electromagnetic induction coils.

5. The method of claim 3 or 4, wherein the first and second electromagnetic induction coils are each coils of multi-phase and multi-pole arrangement spaced peripherally around the mold at their respective locations.

6. The method of claim 1, wherein the second rotating magnetic field employed to effect a stirring motion in the meniscus area sufficient to counterbalance stirring motion produced in that area by the first rotating magnetic field at its downstream location of application.

7. The method of claim 1, wherein the second rotating magnetic field is employed to effect a stirring motion in the meniscus area sufficient to enhance that stirring motion to a level exceeding the stirring intensity produced in the meniscus by the first magnetic field at its downstream location of application.

8. The method of claim 6, including controlling the reduction of stirring motion in the meniscus by proportionating values of respective magnetic torques of the second and the first magnetic fields to provide a predetermined level of stirring intensity in the meniscus is sustained within a full range of the power input into the first electromagnetic induction coils.

9. The method of claim 8, wherein said proportionating values of the magnetic torque is achieved by proportionating values of the power input to the first and second electromagnetic induction coils.

10. The method of claim 7, including controlling the enhancement of stirring motion in the meniscus by proportionating values of respective magnetic torques of the second and the first magnetic fields by proportionating the values of the corresponding power inputs to said second and first electromagnetic induction coils.

11. The method of claim 1 including controlling stirring motion in the meniscus by using different frequencies for the first and the second magnetic fields.

12. The method of claim 11 wherein the first and the second magnetic fields operating at different frequencies are superimposed to produce a polyharmonic resultant magnetic field with an oscillating beat whose base frequency is lower than the frequency of either the first or the second original magnetic fields.

13. The method of claim 12, wherein said polyharmonic resultant magnetic field produces dynamic forces which initiate parametric resonance within the molten metal in the mold and/or at an interface between liquid and solid phases within the mold when oscillatory frequencies of said dynamic forces are close to or coincide with frequencies at which the liquid metal and/or dendrites attached to said interface oscillate in the field of gravity.

14. The method of claim 13, wherein said dynamic forces include magnetic force, magnetic pressure and momentum and the parametric resonance amplifies the amplitude of the dynamic forces to provide a more effective crystal fragmentation and solidification structure refinement.

15. The method of claim 13, wherein the dynamic forces include magnetic force, magnetic pressure and momentum and the parametric resonance amplifies dynamic forces to cause cavitation of the liquid metal at said interface, to result in local shock waves and further contribution to the crystal fragmentation and solidification structure refinement and removal of gases from the molten metal.

16. The method of claim 13 including optimizing the base frequency of the polyharmonic resultant magnetic field and its amplitude of oscillation to obtain the best effect of parametric resonance by adjusting the ratio of the original magnetic field frequencies produced by the first and second electromagnetic induction coils and current input to the respective first and second electromagnetic induction coils.

17. The method of claim 12, wherein the polyharmonic resultant magnetic field is obtained through an arrangement of the first and second electromagnetic induction coils on a common iron yoke and poles and the first and second electromagnetic coils are supplied with separate currents of different frequencies.

18. The method of claim 1, wherein said liquid metal is steel.

* * * * *